US010213067B2

(12) United States Patent
Roberts et al.

(10) Patent No.: US 10,213,067 B2
(45) Date of Patent: Feb. 26, 2019

(54) DISPENSER

(71) Applicant: Medline Industries, Inc., Mundelein, IL (US)

(72) Inventors: Derek Roberts, Chicago, IL (US); Michael Turturro, Arlington Heights, IL (US); Matthew Kruse, Arlington Heights, IL (US)

(73) Assignee: Medline Industries, Inc., Northfield, IL (US)

( * ) Notice: Subject to any disclaimer, the term of this patent is extended or adjusted under 35 U.S.C. 154(b) by 516 days.

(21) Appl. No.: 14/978,003

(22) Filed: Dec. 22, 2015

(65) Prior Publication Data

US 2017/0172359 A1 Jun. 22, 2017

(51) Int. Cl.
*A47K 10/18* (2006.01)
*A47K 10/32* (2006.01)

(52) U.S. Cl.
CPC .... *A47K 10/185* (2013.01); *A47K 2010/3233* (2013.01); *A47K 2010/3266* (2013.01)

(58) Field of Classification Search
CPC ..... A47K 10/18; A47K 10/185; A47K 2010/3266; A47K 2010/3233
USPC ..... 206/449, 494, 823
See application file for complete search history.

(56) References Cited

U.S. PATENT DOCUMENTS 2,338,604 A 1/1944 Silveyra
3,252,632 A 5/1966 Hagenes
3,986,479 A 10/1976 Bonk
4,240,271 A 12/1980 Brownlow
4,790,436 A 12/1988 Nakamura
5,469,987 A 11/1995 Honkawa
5,516,001 A 5/1996 Muckenfuhs
5,715,971 A 2/1998 Morand
5,718,353 A 2/1998 Kanfer
6,158,614 A 12/2000 Haines
6,220,435 B1 4/2001 Nobile
6,299,027 B1 10/2001 Berge
6,431,380 B1 8/2002 Branson
6,634,037 B2 10/2003 Turbett
6,648,132 B1 * 11/2003 Smouha ..... A45C 11/12 206/301
6,899,250 B2 5/2005 FitzSimons
6,948,643 B1 9/2005 Lohrman
(Continued)

FOREIGN PATENT DOCUMENTS

EM 0748748 A1 12/1996
EP 0502751 A2 9/1992
(Continued)

*Primary Examiner* — King M Chu
(74) *Attorney, Agent, or Firm* — Fitch, Even, Tabin & Flannery LLP

(57) ABSTRACT

A dispenser includes a dispenser body having an interior cavity, and an aperture that communicates with the interior cavity. The dispenser also includes a loading door and a lid. The lid engages a dispenser surface when in the closed position to thereby create a substantially gas impermeable seal. The dispenser further includes a mounting surface disposed within the interior cavity and proximal the aperture. The mounting surface includes a mounting interface that permits substantially gas impermeable mounting of a cartridge while permitting access to the cartridge from the exterior of the dispensing body through the aperture.

20 Claims, 22 Drawing Sheets

(56) References Cited

U.S. PATENT DOCUMENTS

| | | | | |
|---|---|---|---|---|
| 8,777,053 | B2 | 7/2014 | Bunoz | |
| 2004/0173635 | A1 | 9/2004 | Bunoz | |
| 2005/0067313 | A1 | 3/2005 | Banik | |
| 2006/0118567 | A1 | 6/2006 | Linnebur | |
| 2006/0157496 | A1 | 7/2006 | Tagliareni | |
| 2006/0283752 | A1* | 12/2006 | Alegre de Miquel ..... | A47K 10/421 206/494 |
| 2006/0283873 | A1 | 12/2006 | Bostic | |
| 2009/0200331 | A1 | 8/2009 | Bunoz | |
| 2010/0300915 | A1* | 12/2010 | Kakura ..... | B65D 75/5838 206/494 |
| 2011/0011767 | A1* | 1/2011 | Gehring ..... | B65D 83/0811 206/581 |
| 2011/0309099 | A1* | 12/2011 | Bandoh ..... | B65D 43/166 220/849 |

FOREIGN PATENT DOCUMENTS

| | | | |
|---|---|---|---|
| EP | 1000577 | A1 | 5/2000 |
| GB | 1406124 | A | 9/1975 |
| WO | 2001005679 | A1 | 1/2001 |

* cited by examiner

DISPENSER

TECHNICAL FIELD

The present disclosure generally relates in some aspects to a dispenser and in other aspects to a dispenser system having a dispenser and a cartridge. In still other aspects, the disclosure generally relates to methods for providing an airtight seal between a cartridge and a dispenser.

BACKGROUND

Disposable wipes are often sold in disposable wipe containers. The wipes are typically sheets of paper or cloth, and may be dry or pre-moistened. For example, in healthcare facilities, disposable pre-moistened wipes often include disinfectant or sanitizing formulas. Wipes intended for use on infant skin are also typically sold as pre-moistened wipes.

In many conventional dispensers, it is advantageous to provide a wipe dispenser to house the disposable wipe cartridges. Dispensers often include a lid to cover the wipe cartridge and wipes when not in use. Even in the closed position, ambient air may pass through spaces between lid and the dispenser (or through other apertures in the dispenser) and into the wipe cartridge. Over time, the air dries out the pre-moistened wipes, rendering the wipes less desirable or even unfit for their intended use. Air gaps in the dispenser may also allow bacteria to enter into the interior of the wipe cartridge.

To address the above, a dispenser with substantially airtight features is now provided.

Figure 1:
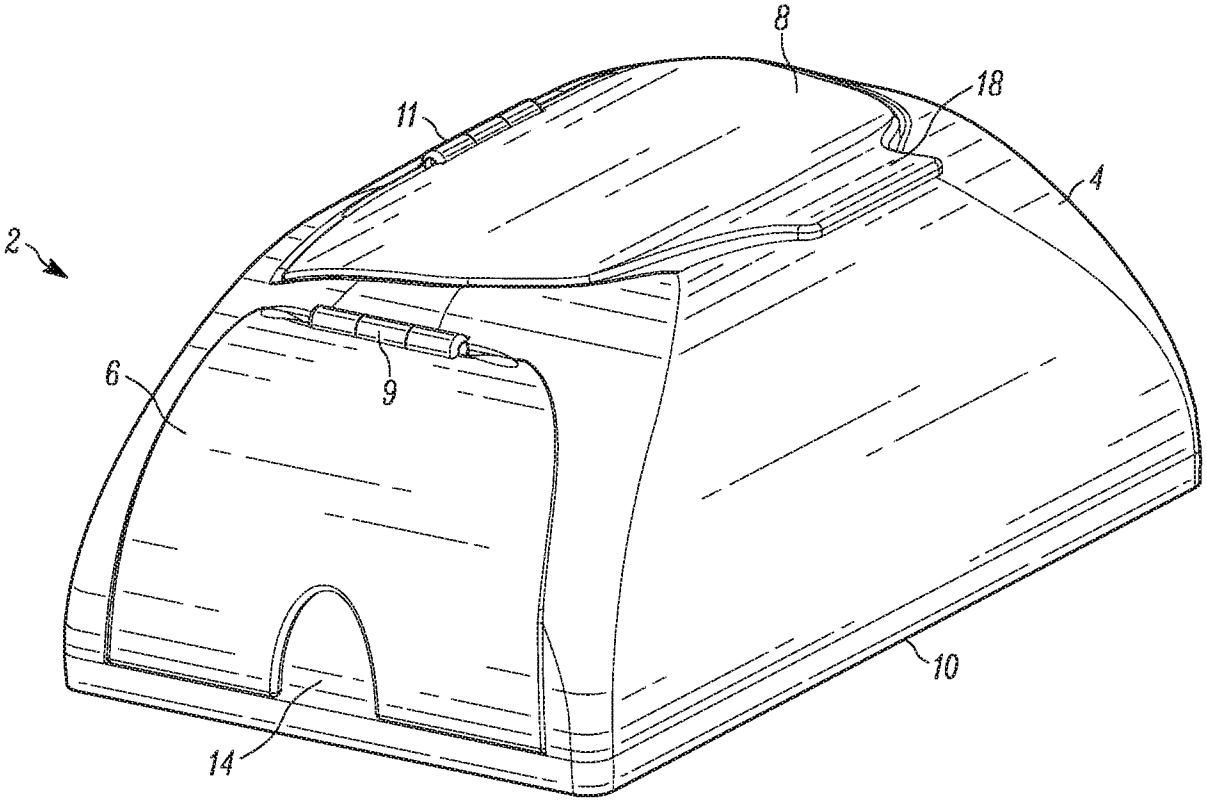
FIG. 1 is a perspective view of a dispenser in accordance with one embodiment.

References to "top," "left," "front," "right," and other points of direction are for internal reference and are not intended to limit the orientation of the dispenser in use. Skilled artisans will appreciate that elements in the figures are illustrated for simplicity and clarity and have not necessarily been drawn to scale.

DESCRIPTION

As used herein, the term "wipes" refers to sheet portions that may be, for example, a paper or non-woven cloth. The sheet portions may form a continuous sheet with perforations to allow a user to tear the sheet into discrete wipes. The sheet portions may instead take the form of pre-cut discrete wipes. Pre-cut wipes are typically interlocked with adjacent wipes such that removal of a first wipe pulls the next wipe partially outside of the cartridge. The wipes may be pre-moistened during manufacture by applying a liquid disinfectant, sanitizing, or lubricating formula. The wipes may also be dry wipes that may be used, for example, as wiping or absorbing sheets.

The dispenser advantageously provides substantially airtight seals between the cartridge and the dispenser, and between a dispenser lid and the dispenser. This refers to a seal between two surfaces that is substantially gas impermeable at atmospheric pressure. In this way, ambient air is substantially inhibited from passing through the seals provided by the dispenser. The airtight seals of the dispenser inhibit ambient air from drying out the wipes or introducing bacteria to the wipes.

Referring now to the drawings, and in particular to FIGS. 1-7, the dispenser 2 includes a dispenser body 4, a loading door 6, and a lid 8. In a preferred approach, at least one exterior surface of the dispenser 2 is a substantially flat surface 10 for resting on a horizontal table or like surface. As shown in FIGS. 3-7, and in particular FIG. 7, the flat surface 18 may include a wall mount interface 12 that permits mounting of the dispenser 2 to a wall.

Figure 2:
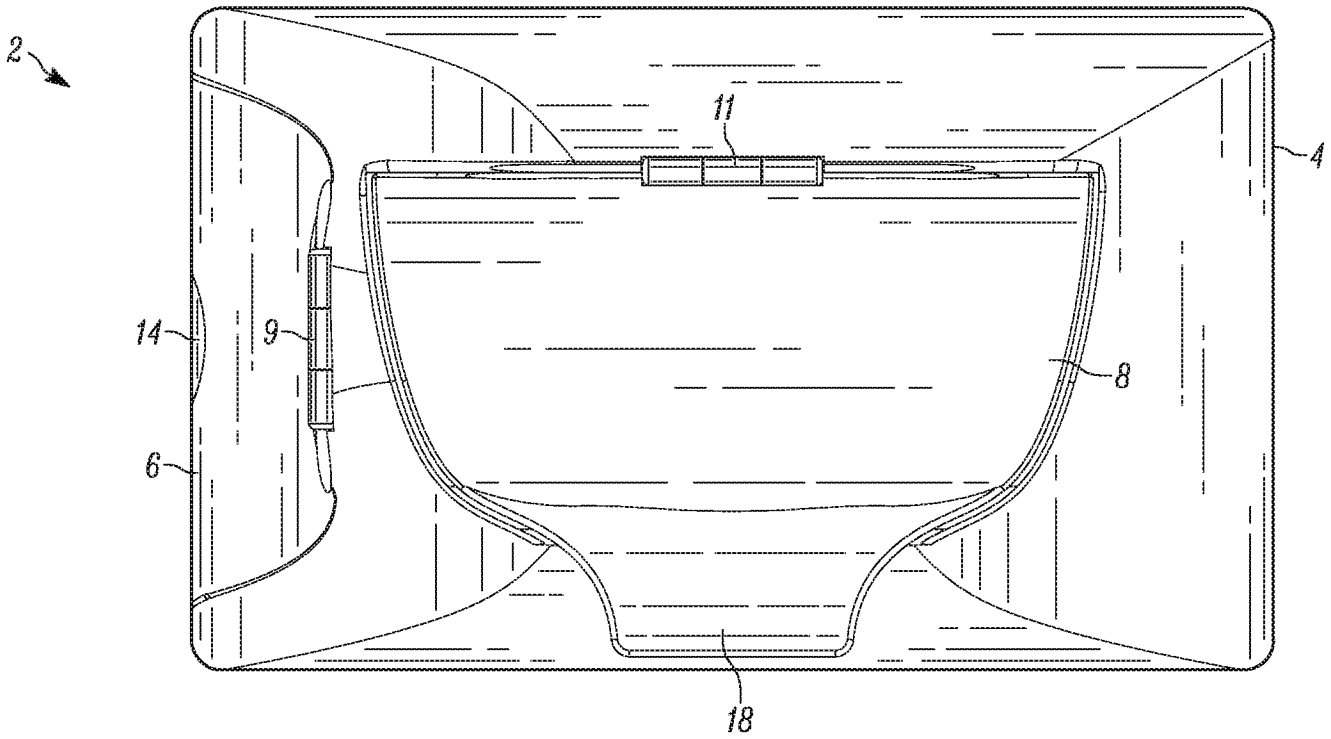
FIG. 2 is a top plan view of the dispenser of FIG. 1.
Figure 3:
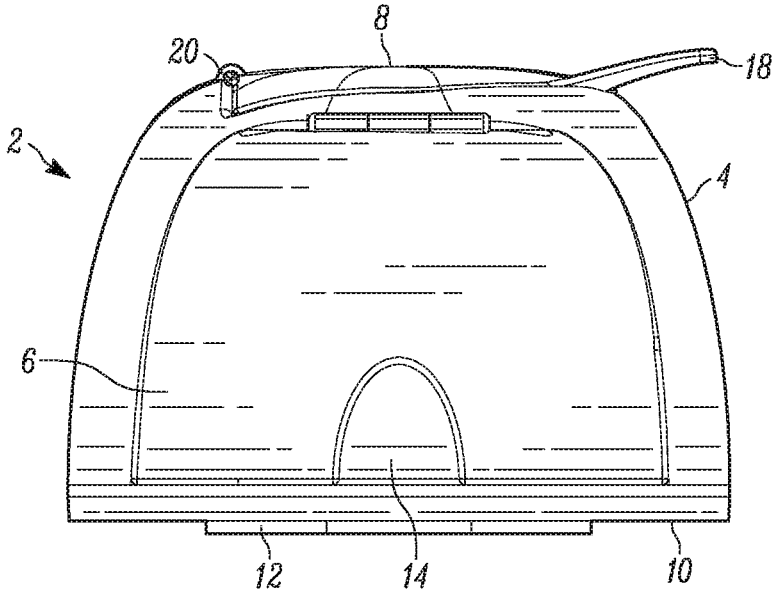
FIG. 3 is a left side elevational view of the dispenser of FIG. 1.
Figure 4:
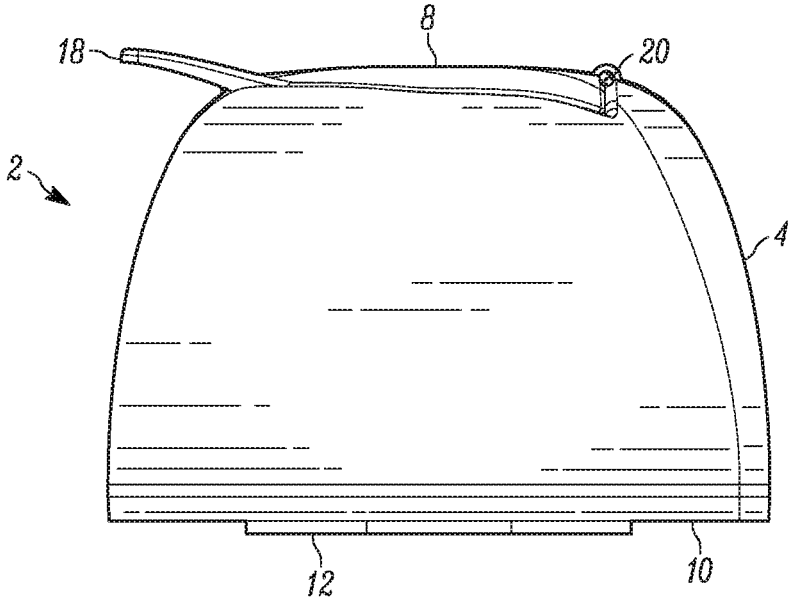
FIG. 4 is a right side elevational view of the dispenser of FIG. 1.
Figure 5:
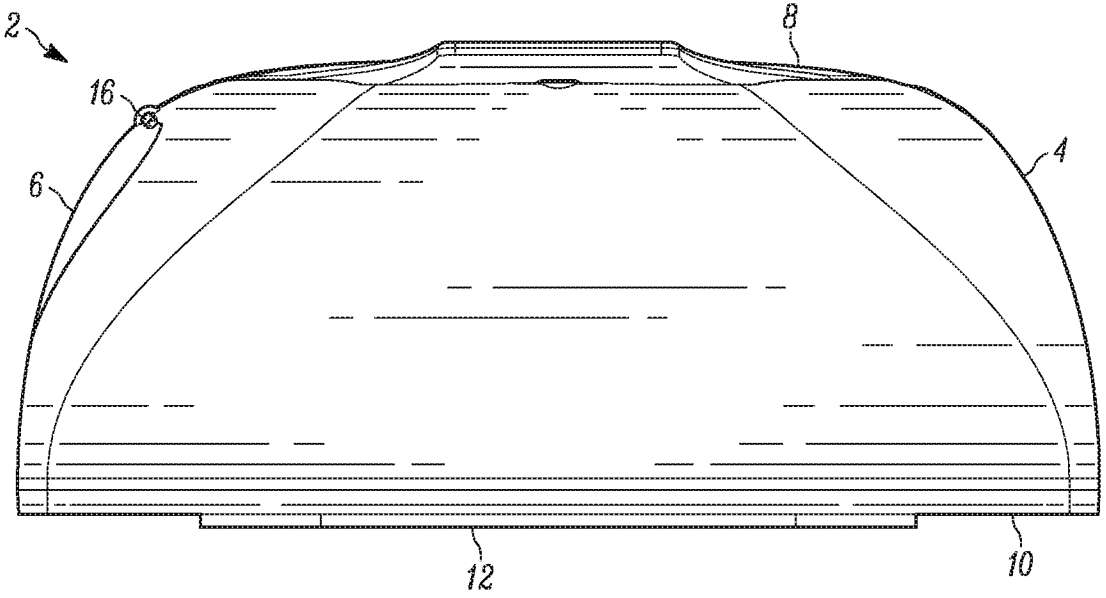
FIG. 5 is a front elevational view of the dispenser of FIG. 1.
Figure 6:
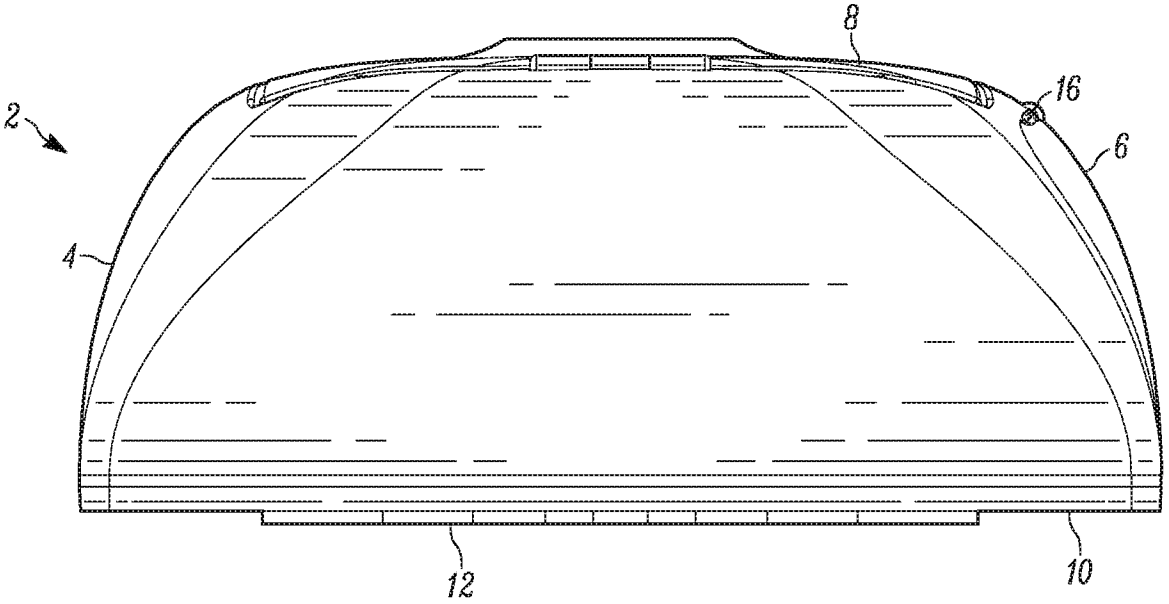
FIG. 6 is a rear elevational view of the dispenser of FIG. 1.
Figure 7:
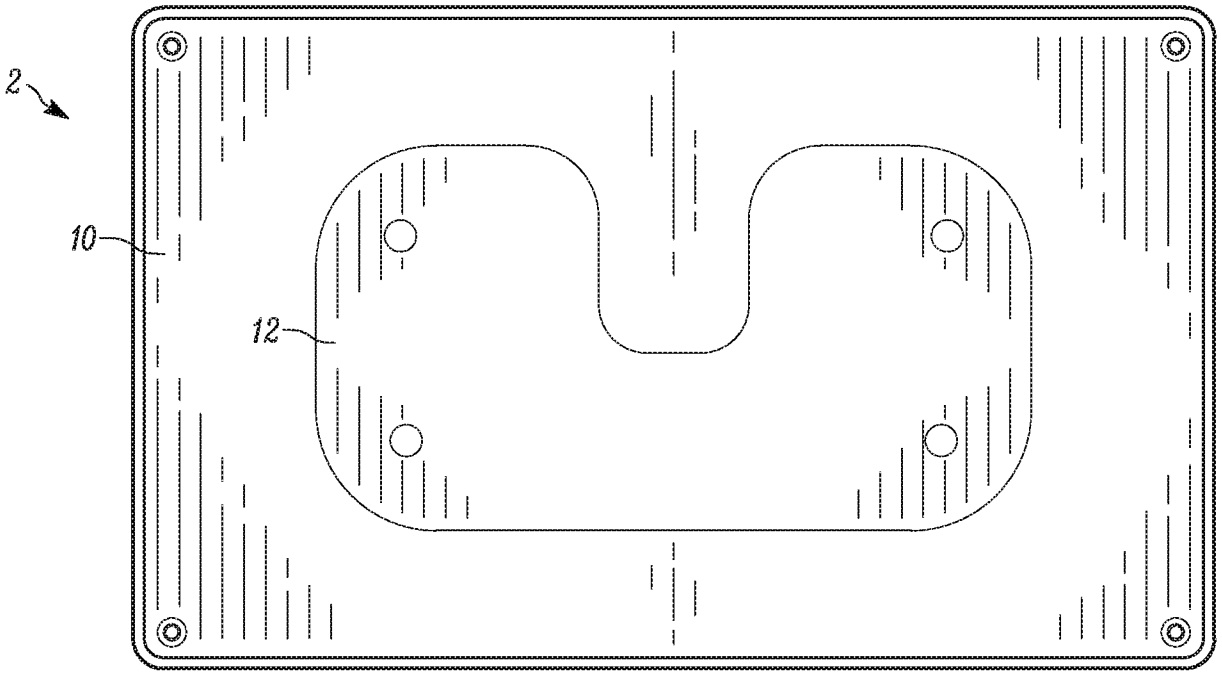
FIG. 7 is a bottom plan view of the dispenser of FIG. 1.

The loading door 6 is preferably pivotably mounted to the dispenser body 4 via a hinge assembly 9 (FIGS. 1 and 2). The loading door 6 includes an aperture 14 that aids the user in opening the loading door 6. For example, a user desiring to open the loading door 6 inserts a finger into the aperture 14, grips the loading door 6, and pivots the loading door 6 about a pivot bar 16 (shown in FIGS. 5 and 6) to an open position. Other approaches for mounting the loading door 6 to the dispenser body 4 and for opening the loading door 6 are possible. Opening the loading door 6 permits user access to the interior cavity of the dispenser 2 to insert or remove a cartridge.

The lid 8 is also preferably pivotably mounted to the dispenser body 4 via hinge a assembly 11 (FIGS. 1 and 2). The lid 8 includes a user interface such as a tab 18 that aids the user in opening the lid 8. For example, a user desiring to open the lid 8 lifts the tab 18 and pivots the lid 8 about a pivot bar 20 to an open position. The tab 18 preferably extends a sufficient distance (e.g., 1 inch) from the dispenser 2 to permit a user to open the lid 8 with the user's finger, and in some approaches, extends a sufficient distance (e.g., 2 inches) from the dispenser 2 to permit a user to open the lid 8 with, for example, the back of the user's hand or the user's forearm. Other approaches for mounting the lid 8 to the dispenser body 4 and for opening the lid 8 are possible.

Figure 8:
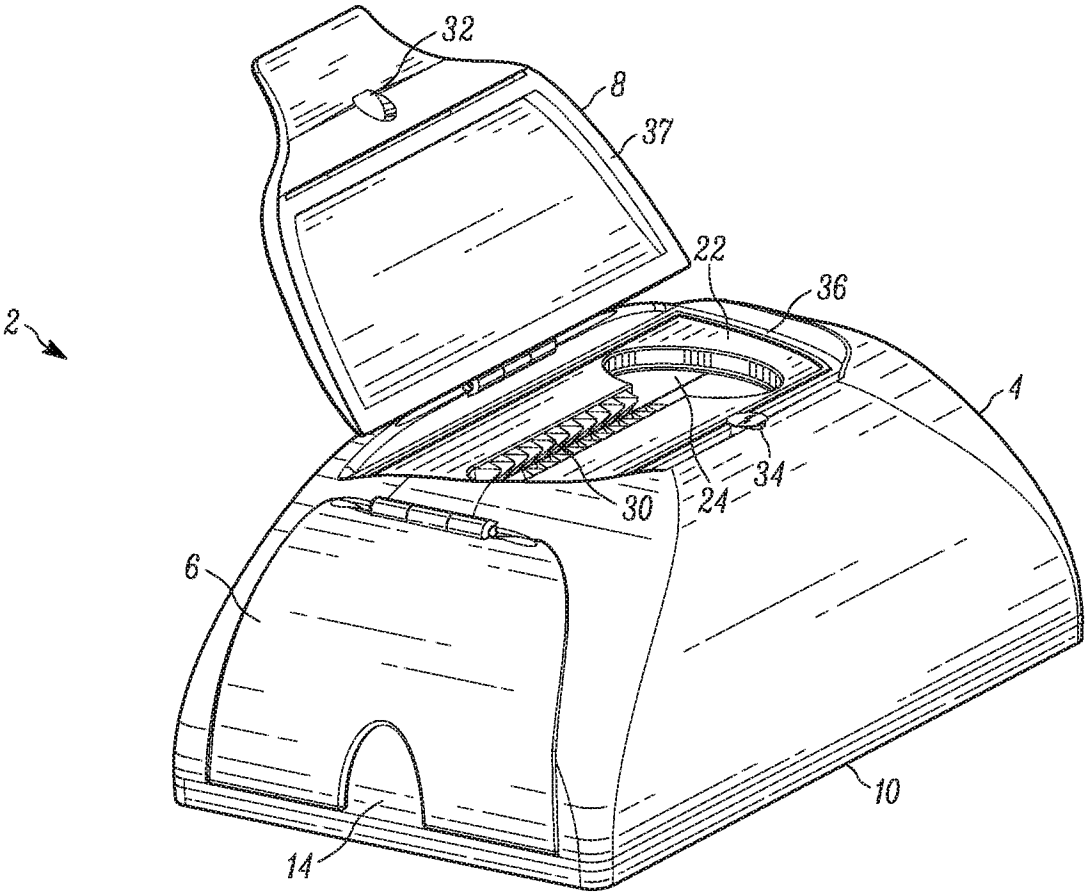
FIG. 8 is a perspective view of the dispenser of FIG. 1 showing the lid in an open position.
Figure 9:
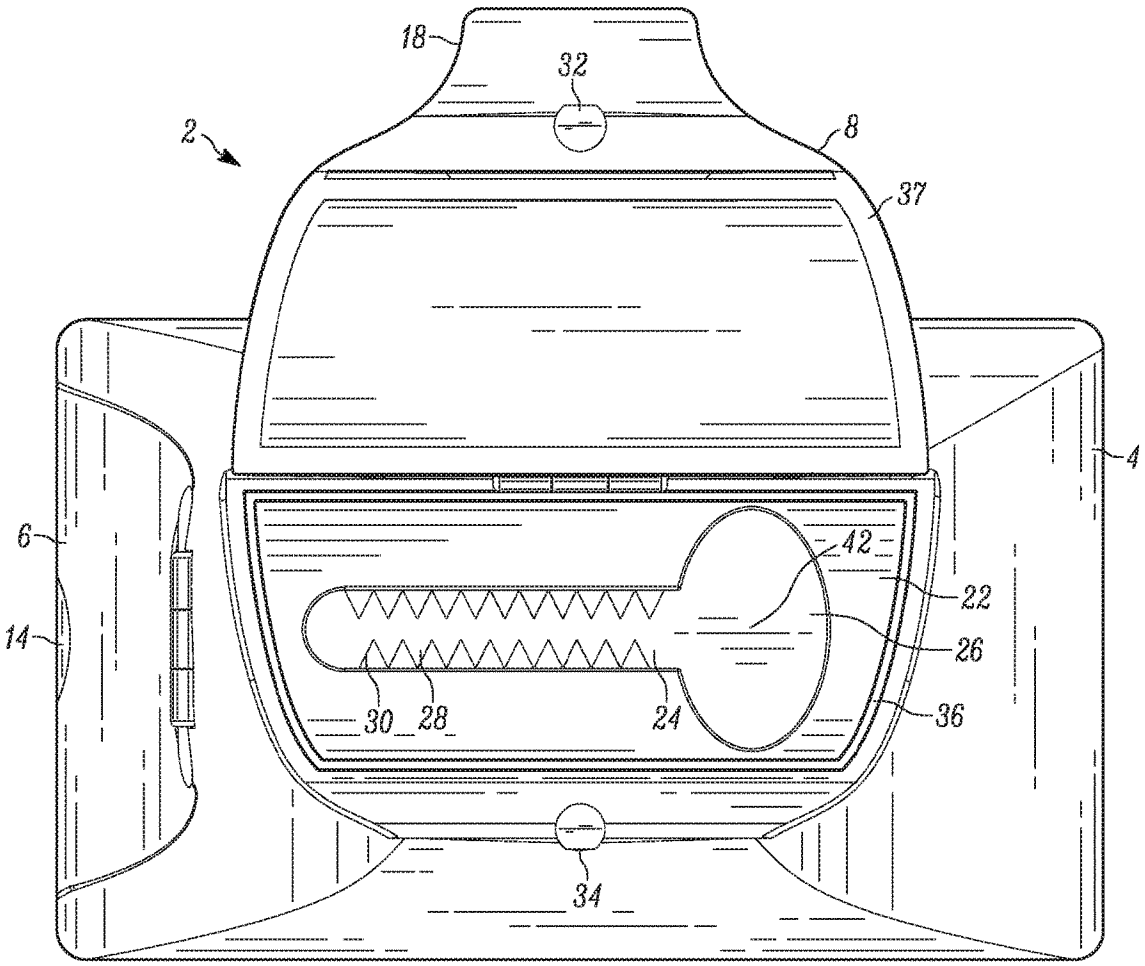
FIG. 9 is a top plan view of the dispenser of FIG. 1 showing the lid in an open position.

As seen in FIGS. 8 and 9, the dispenser body 4 has a dispenser surface 22 that has an aperture 24 disposed therethrough. The aperture 24 provides access from the exterior of the dispenser body 4 to the interior of the dispenser body 4. The aperture 24 may include first and second aperture regions 26, 28 having different dimensions. The first aperture region 26 is preferably sized so as to permit a user to insert one or more fingers into the interior of the dispenser body 4 to access wipes disposed within a cartridge (not shown in FIG. 8 or 9). The second aperture region 28 preferably includes at least one separation surface 30 that facilitates separating each wipe from the next adjacent wipe. As shown in FIGS. 8 and 9, the dispenser body 4 may have two separation surfaces 30, each comprising a plurality of protrusions or teeth that extend into the aperture 24. In another approach, the separation surface may be a sharp ridge (not shown).

As further shown in FIGS. 8 and 9, the lid 8 may include a magnet 32. When the lid 8 is in the closed position, the lid magnet 32 cooperates with a corresponding magnet 34 or ferrous disc (not shown) disposed on the dispenser body 4. The magnets are sized such that an attraction force between the two magnets 32, 34 is sufficiently strong enough to hold the lid 8 securely against the dispenser body 4 when the lid 8 is rotated to the closed position. In another approach, the magnet 34 of the dispenser body cooperates with a corresponding ferrous disc (not shown) disposed on the lid 8. The positions of the magnet and ferrous disc may be reversed.

With reference to FIGS. 8 and 9, the dispenser surface 22 of the dispenser body 4 preferably includes a gasket 36. The gasket 36 is disposed at the perimeter of the dispenser surface 22 to thereby surround the aperture 24. When in the closed position, a perimeter region 37 of the lid 8 presses against the gasket 26, thereby creating a substantially airtight seal. This substantially airtight seal inhibits ambient air from passing through the aperture 24 when the lid 8 is in the closed position.

Figure 10:
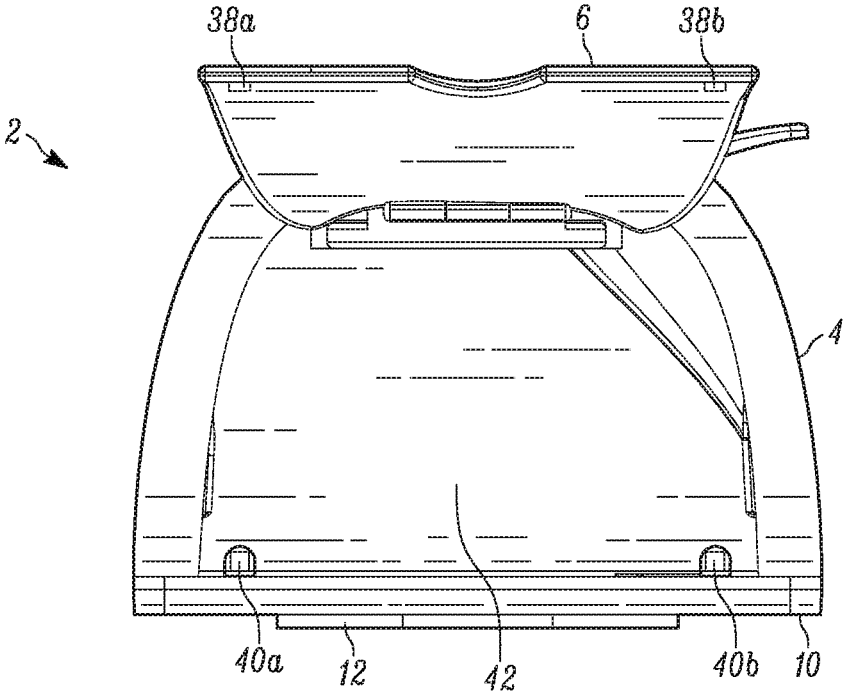
FIG. 10 is a left side elevational view of the dispenser of FIG. 1 showing the loading door in an open position.
Figure 11:
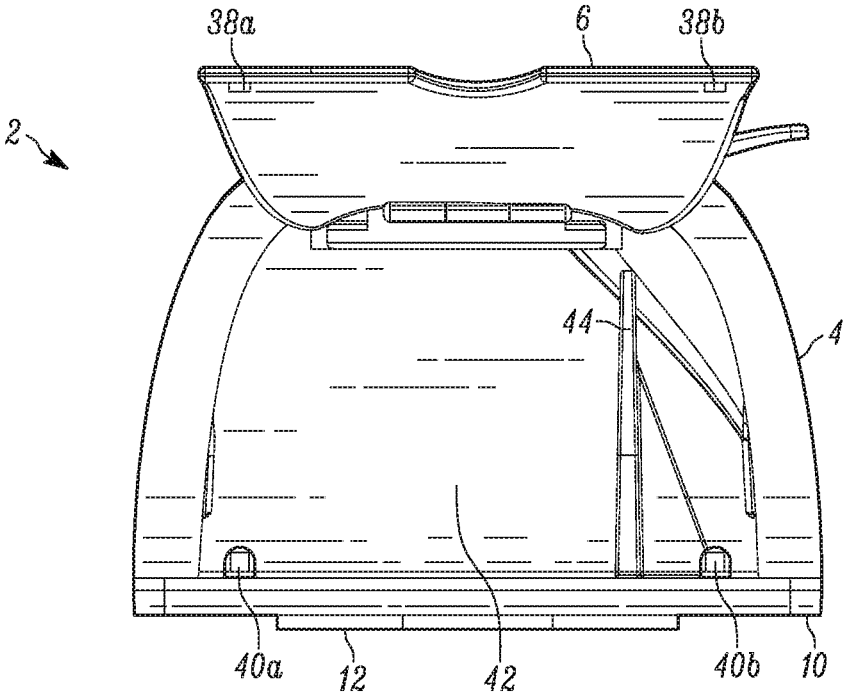
FIG. 11 is a left side elevational view showing an alternative embodiment of a dispenser with an interior shelf.
Figure 12:
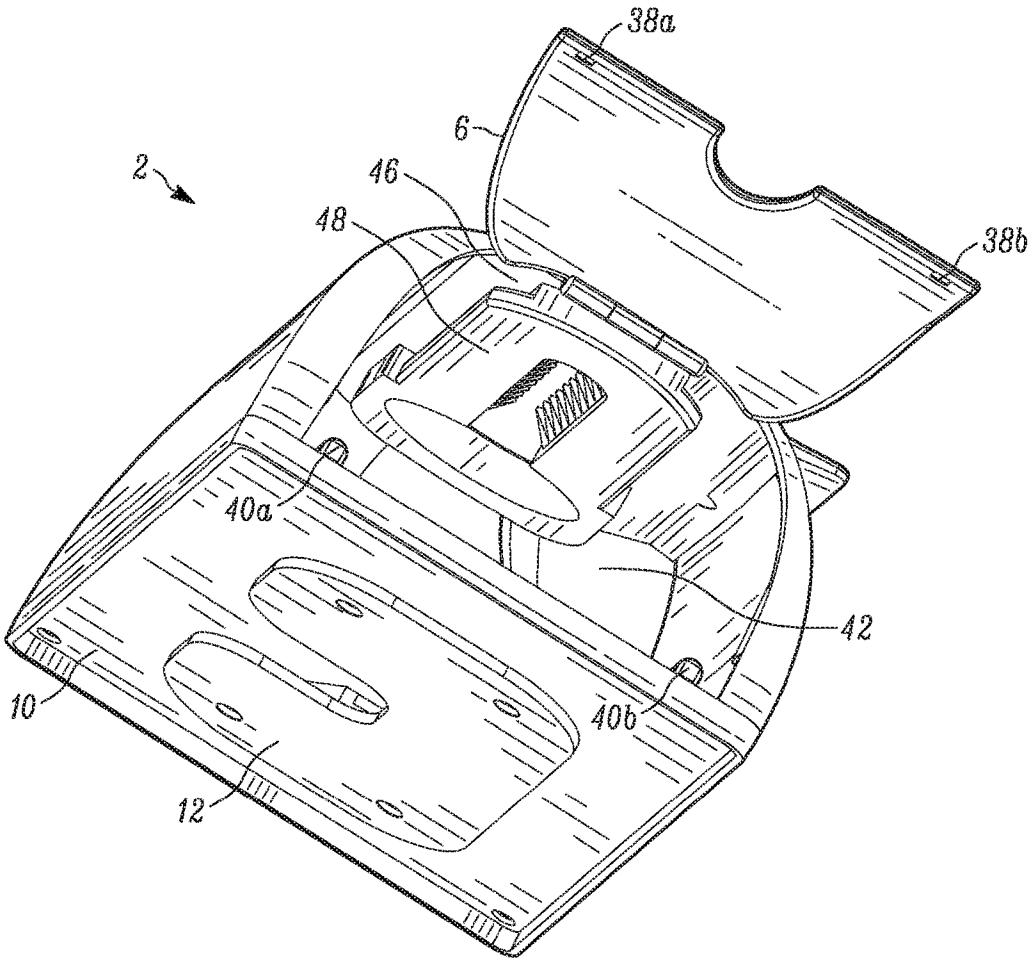
FIG. 12 is a bottom perspective view of the dispenser of FIG. 1 looking into the interior of the dispenser.
Figure 13:
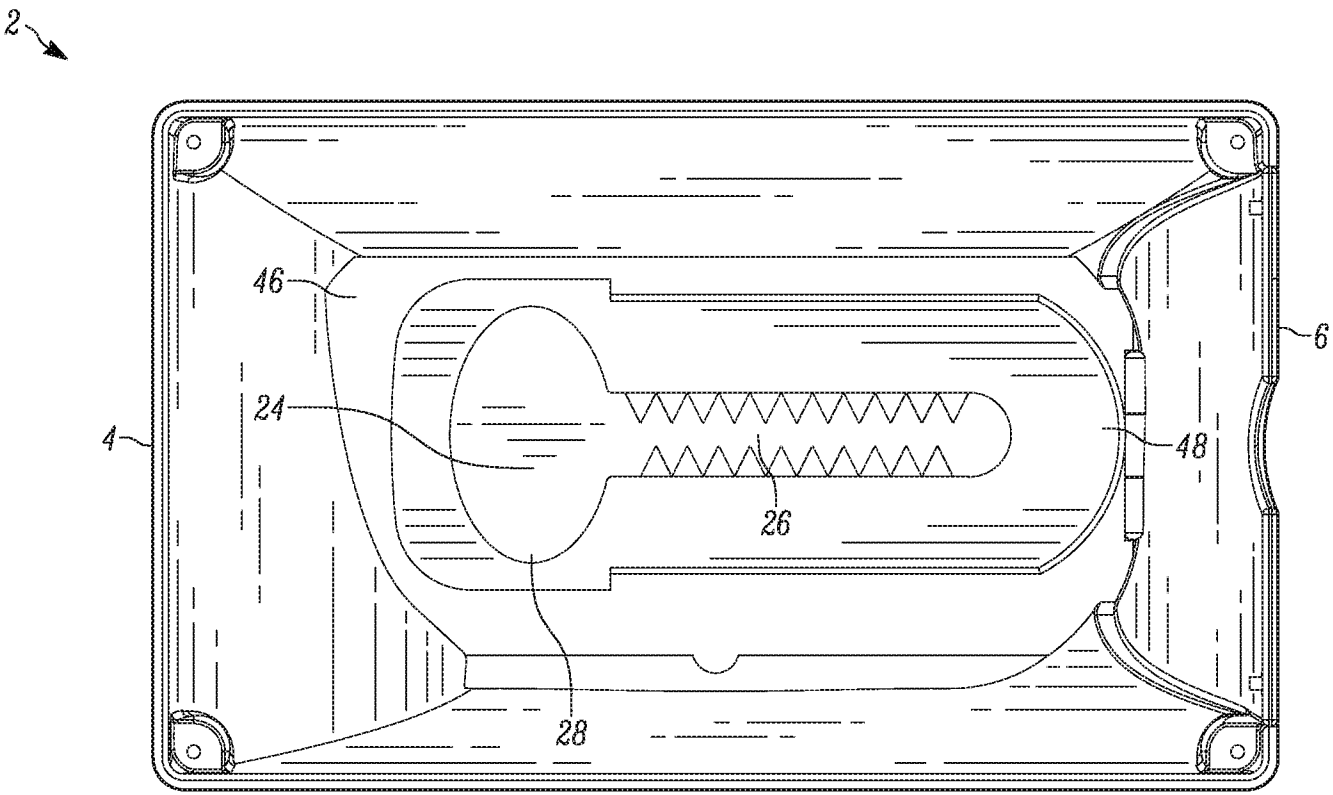
FIG. 13 is a bottom plan view of the dispenser of FIG. 1 with the bottom surface removed.

As shown in FIGS. 10-12 the loading door may include one or more magnets 38*a*, 38*b*. When the loading door 6 is in the closed position, the loading door magnets 38*a*, 38*b* interface with magnets 40*a*, 40*b* disposed on the dispenser body 4. An attraction force between the two sets of magnets 38*a*, 38*b* and 40*a*, 40*b* is sufficiently strong enough to hold the loading door 6 securely against the dispenser body 4 when the loading door 6 is rotated to the closed position. In some approaches, one of the sets of magnets (e.g., magnets 38*a*, 38*b*) cooperates with corresponding ferrous discs (not shown) disposed, for example, on the dispenser body 4. Alternatively, the magnets may be disposed on the dispenser body and the ferrous disks may be disposed on the loading door. In other approaches, a greater or smaller number of magnets or a different type of connector may be employed As shown in FIG. 10, the interior cavity 42 of the dispenser 2 is substantially empty. In an alternative approach, shown in FIG. 11, a shelf 44 extends into the interior cavity 42. The shelf 44 may serve to aid in aligning a cartridge (not shown in FIG. 11) with the aperture 24. When the dispenser 2 is mounted to a wall, the shelf 44 may additionally serve to support the weight of a cartridge within the interior cavity 42.

Referring to FIGS. 12-15, a mounting surface 46 is located within the interior cavity 42 near the aperture 24 of the dispensing surface 22. The mounting surface 46 includes a mounting interface 48 that enables mounting of a cartridge (not shown in FIGS. 12-15) within the dispenser 2.

Figure 14:
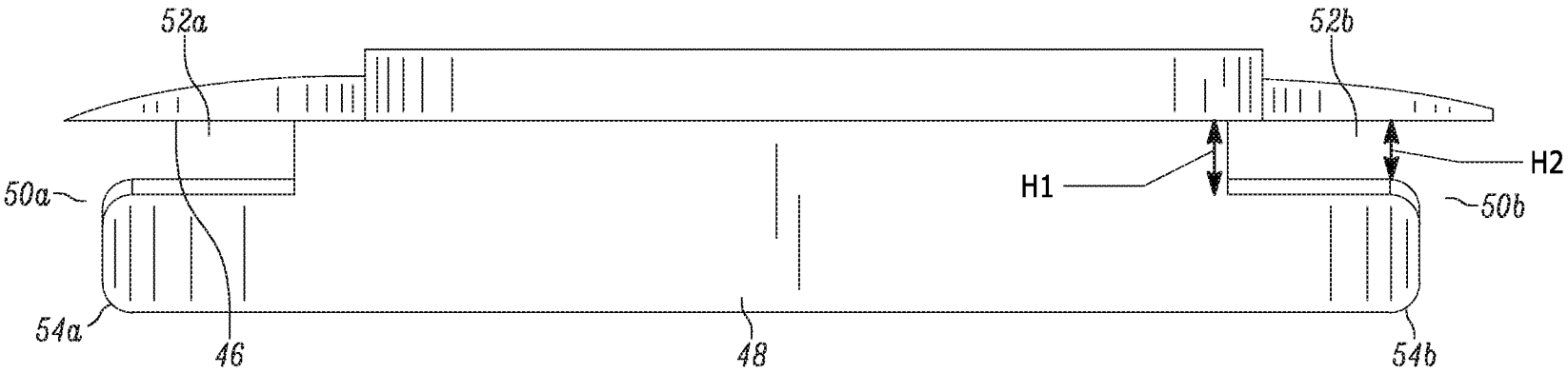
FIG. 14 is side elevational view of the mount of the dispenser of FIG. 1.
Figure 15:
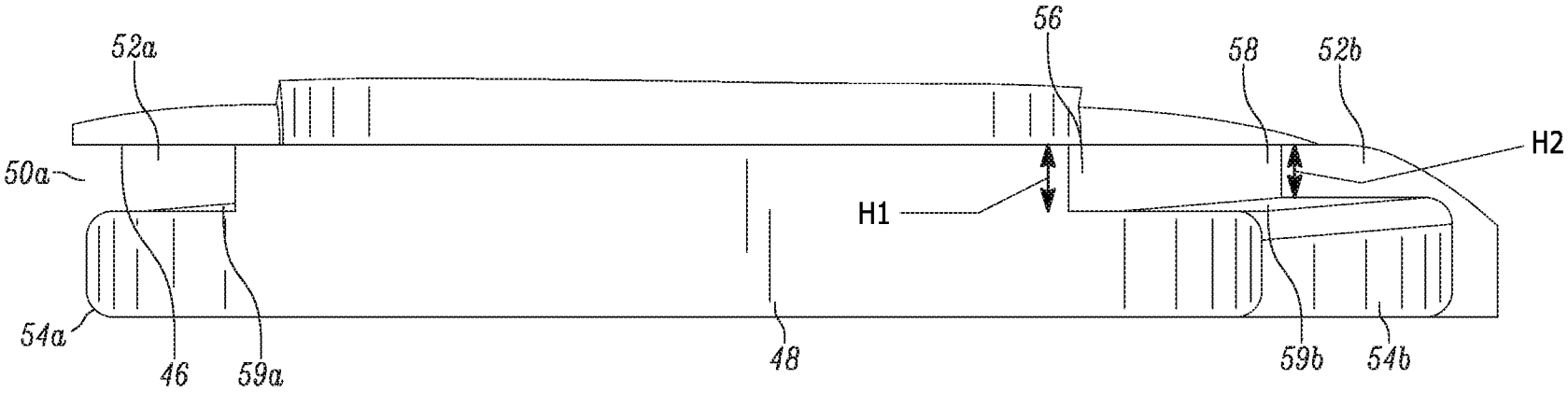
FIG. 15 is a partially rotated side elevational view of the mount of FIG. 14.
Figure 16:
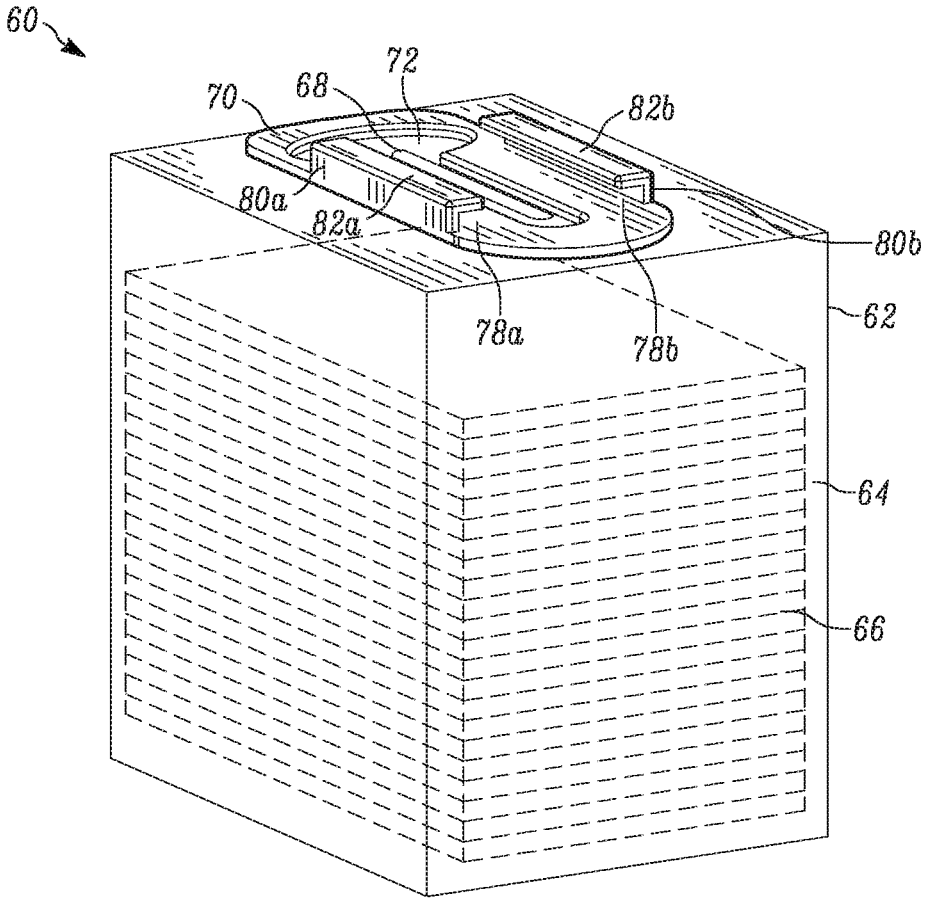
FIG. 16 is a perspective view of a cartridge suitable for use with the dispenser of FIG. 1.
Figure 17:
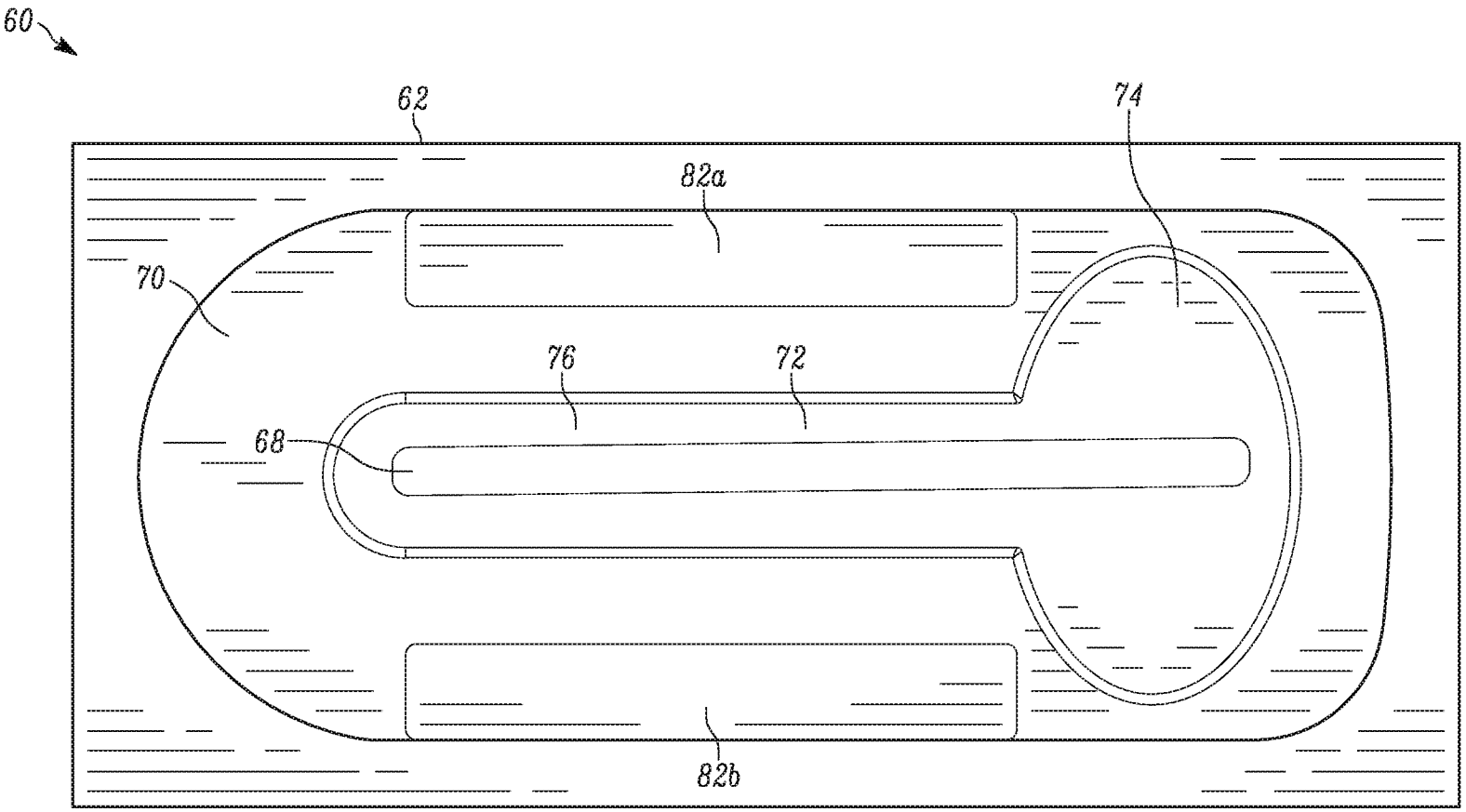
FIG. 17 is a top plan view of the cartridge of FIG. 16.
Figure 18:
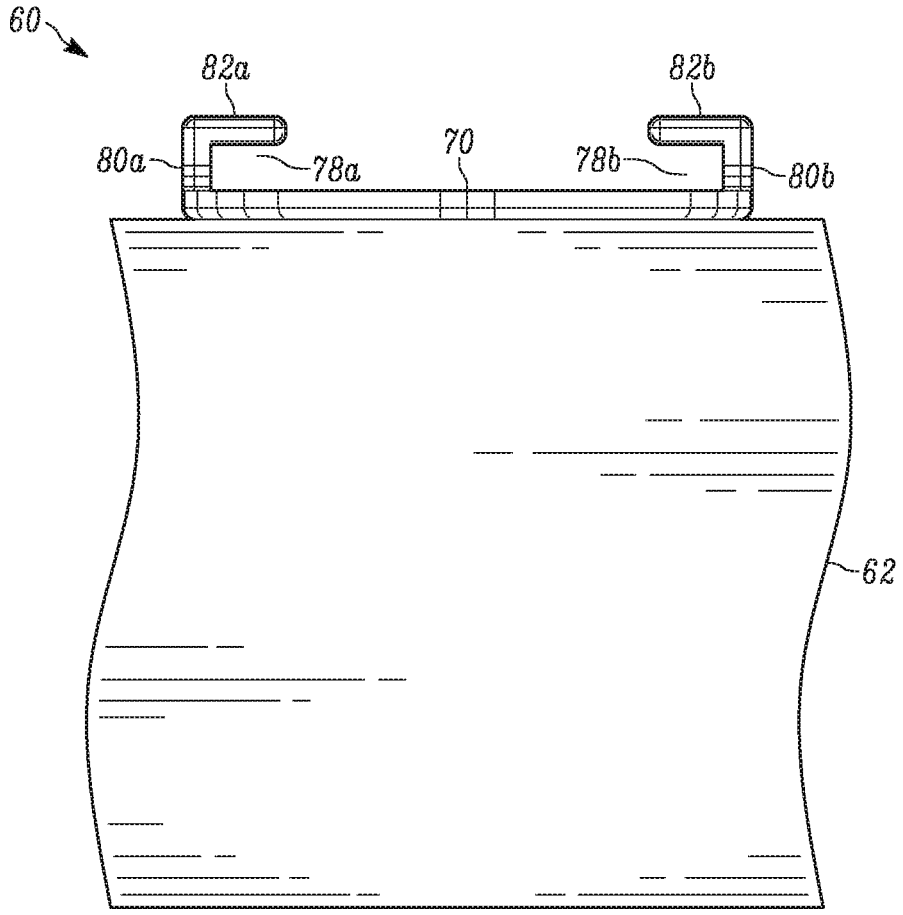
FIG. 18 is a left side elevational view of the cartridge of FIG. 16.
Figure 19:
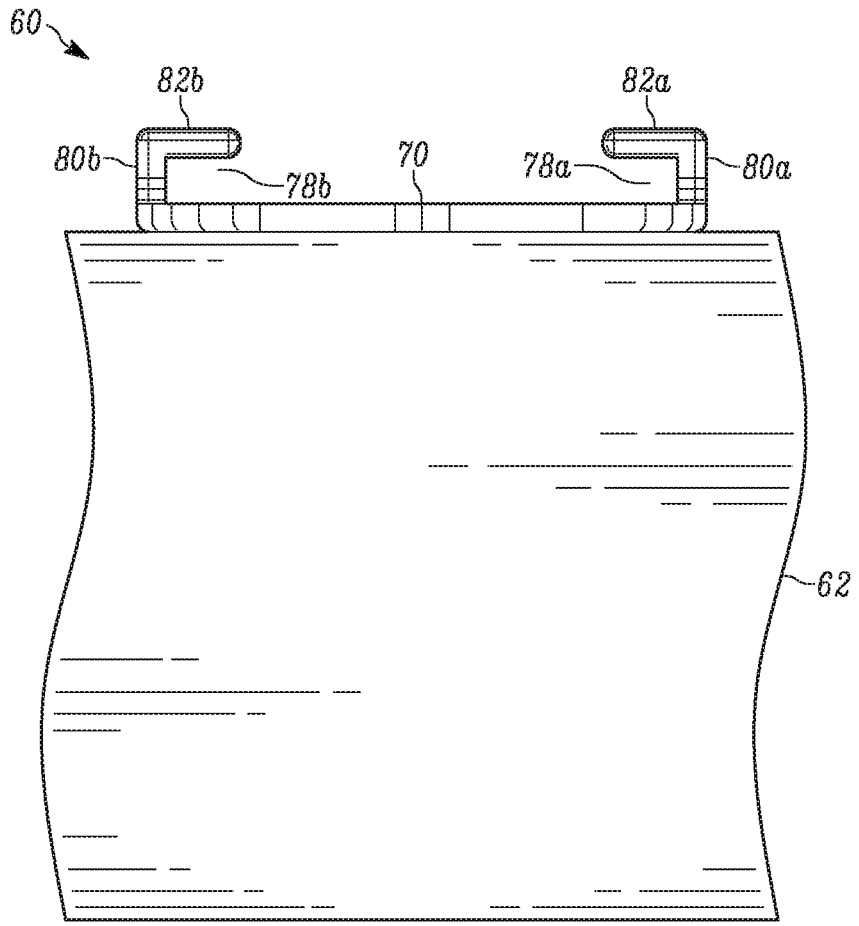
FIG. 19 is a right side elevational view of the cartridge of FIG. 16.
Figure 20:
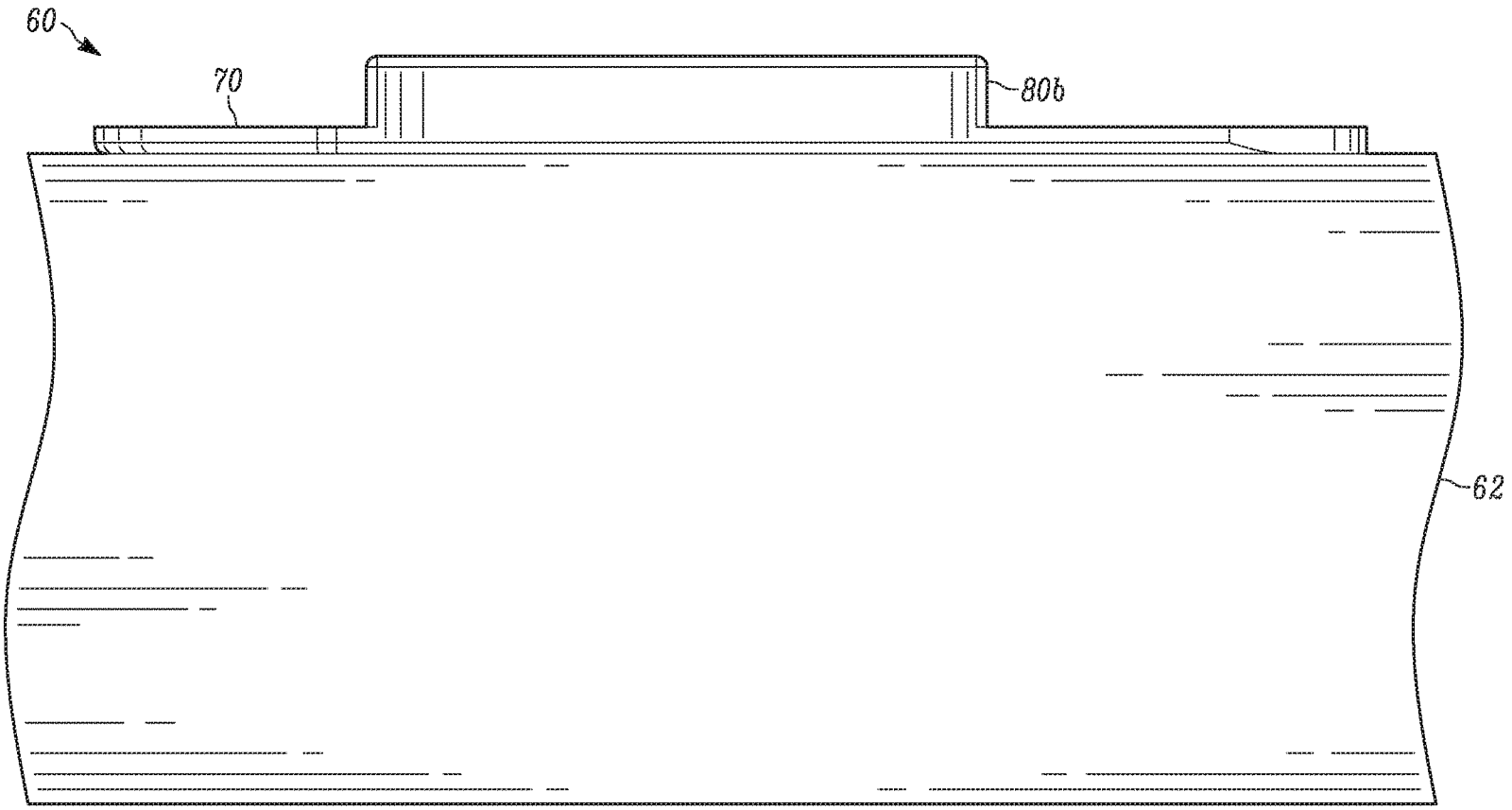
FIG. 20 is a front elevational view of the cartridge of FIG. 16.

As shown in FIGS. 14 and 15, the mounting interface 48 includes at least one, and preferably two, interference fit regions 50*a*, 50*b*. The interference fit regions 50*a*, 50*b* engage a mounting interface of a cartridge (not shown in FIG. 14 or 15) to create a substantially airtight seal between the mounting portions of the cartridge and the interference fit regions 50*a*, 50*b*. The interferences fit regions 50*a*, 50*b* preferably include grooves 52*a*, 52*b*. The heights of the grooves 52*a*, 52*b* are defined by the distances between flanges 54*a*, 54*b* of the mounting interface 48 and the mounting surface 46.

As shown in FIG. 15, groove 52*b* has a first groove height (indicated by H1) at a first groove region 56 and a second groove height (indicated by H2) at a second groove region 58. Preferably, the second groove height W2 is narrower than the first groove height H1. This may be accomplished, for example, by providing the rail 54*b* with a ramped upper surface 59*b*. In this way, the height of the groove 52*b* is height proximal the loading door 6, and narrower distal the loading door 6. In a preferred approach, groove 52*a* has similar geometry as that of groove 52*b*. In an alternative approach (not shown), groove has a constant height along a longitudinal axis of the groove, while groove has a narrowing height along a longitudinal axis of the groove.

Referring now to FIGS. 16-20, a cartridge 60 includes a cartridge body 62 having an interior cartridge cavity 64. The cartridge body is preferably a plastic material and may be, for example, a flexible bag or a rigid canister.

A plurality of wipes 66 are disposed within the interior cartridge cavity 64. As discussed, the wipes 66 may comprise one continuous sheet with perforations, or comprise a plurality of pre-cut sheet portions. The wipes 66 are removed from the interior cartridge cavity 64 through a cartridge aperture 68 of the cartridge body 62. The cartridge aperture 68 may be formed, for example, by tearing a perforation in the cartridge body 62, or by removing an adhesively applied cover (not shown).

The cartridge 60 includes a cartridge mounting interface 70 disposed on an exterior of the cartridge body 62. The cartridge mounting interface 70 includes an aperture 72 that permits access to the cartridge aperture 68 of the cartridge body 62. In a preferred approach, the aperture 72 of the cartridge mounting interface 70 has a profile similar to that of the aperture 24 of the dispensing surface 22. In this way, the aperture 72 of the cartridge mounting interface 70 may include a first aperture region 74 and a second aperture region 76 (shown in FIG. 17).

Returning to FIG. 16, the cartridge mounting interface 70 further includes at least one, and preferably two, cartridge interference fit regions 78*a*, 78*b*. The cartridge interference fit regions 78*a*, 78*b* includes cartridge guides 80*a*, 80*b*. In a preferred approach, cartridge guides 80*a*, 80*b* include rails 82*a*, 82*b* that extend inwardly toward the aperture 72 so that they may be received by the grooves 52*a*, 52*b* of the mounting interface 48 of the dispenser 2. Depending on the groove configuration of the dispenser mounting interface 48, the rails of the cartridge guides 80*a*, 80*b* may instead extend outwardly away from the aperture (not shown).

Figure 21:
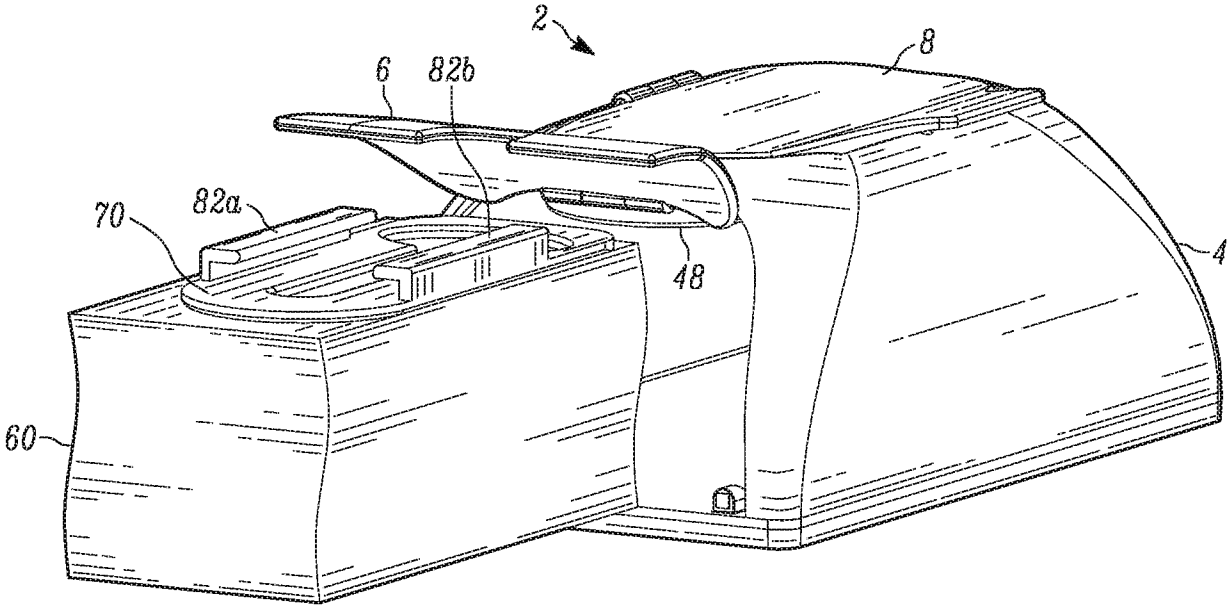
FIG. 21 is perspective view of the dispenser of FIG. 1 showing the loading door in an open position, and the cartridge of FIG. 16 disposed adjacent to the dispenser.

With reference to FIG. 21, to mount the cartridge 60 within the dispenser 2, the cartridge mounting interface 70 is positioned adjacent to the dispenser mounting interface 48. The rails 82*a*, 82*b* of the cartridge guides 80*a*, 80*b* are inserted into grooves (not visible in FIG. 21) of the dispenser mounting interface 48. The cartridge 60 is then slid along a longitudinal axis of the dispenser mounting interface 48 and into the interior cavity 42 of the dispenser 2.

Figure 22:
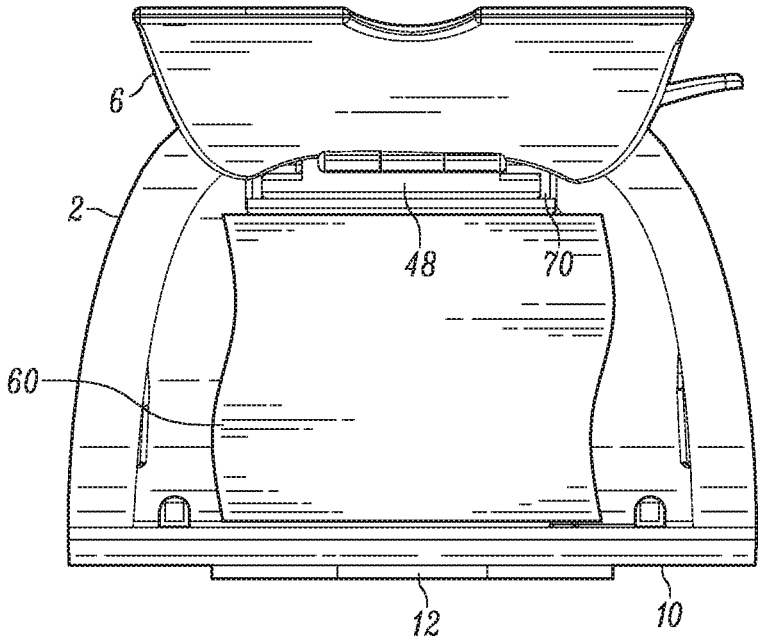
FIG. 22 is a left side elevational view of the dispenser of FIG. 1 showing the loading door in an open position, and the cartridge of FIG. 16 disposed within the interior of the dispenser.
Figure 23:
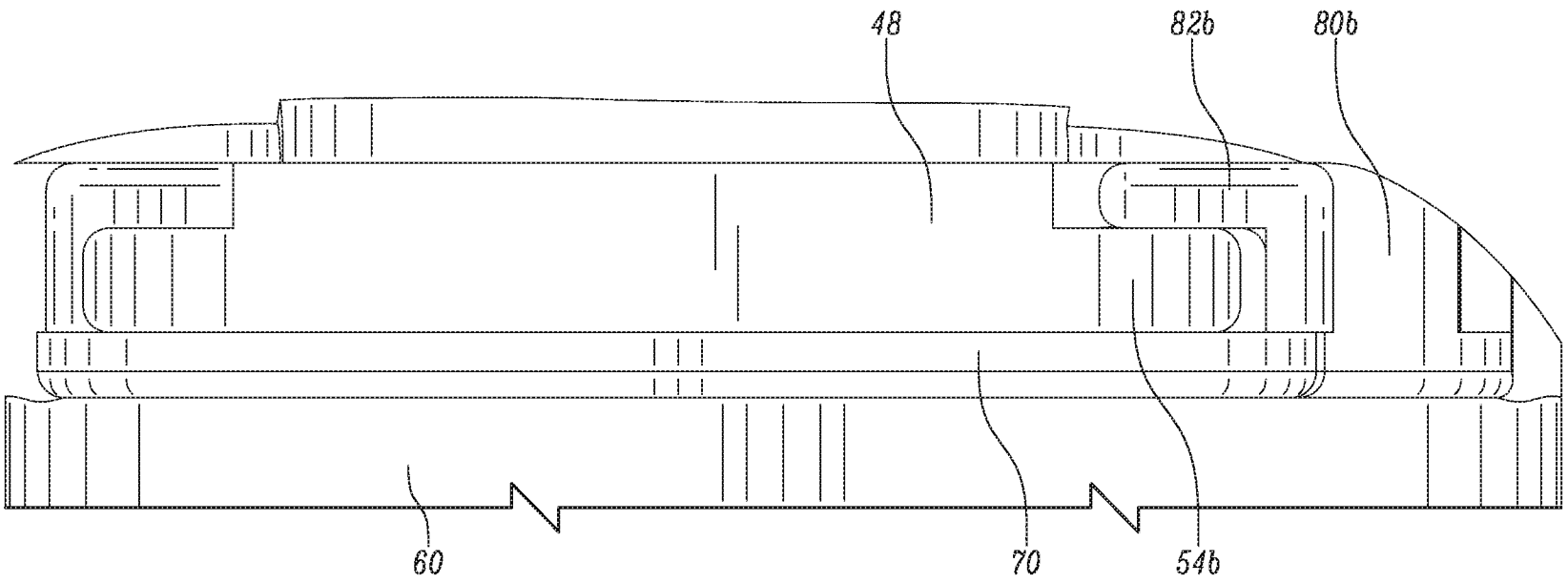
FIG. 23 is a partially rotated side elevational view of the mount of FIG. 14, and the cartridge mount of the cartridge of FIG. 16.

As discussed, the grooves 52*a*, 52*b* narrow in height along the longitudinal axes of the grooves 52*a*, 52*b* in the direction moving away from the loading door 6. Thus, during insertion of the cartridge 60, the rails 82*a*, 82*b* of the cartridge guides 80*a*, 80*b* travel along the ramped upper surfaces 59*a*, 59*b* and are increasingly pressed against the mounting surface 46. This also serves to increasingly pull the cartridge mounting interface 70 against the dispenser mounting interface 48. Upon full insertion of the cartridge 60 within the dispenser 2 (shown in FIGS. 22 and 23), the cartridge mounting interface 70 becomes firmly pressed against the dispenser mounting interface 48 so as to create a substantially airtight seal between the two surfaces. In this way, air entering the interior cavity 42 of the dispenser 2 is substantially inhibited from entering the interior cartridge cavity 64. When all of the wipes have been removed from the cartridge 60, the user may open the loading door, remove the spent cartridge, and insert a new cartridge.

Figure 24:
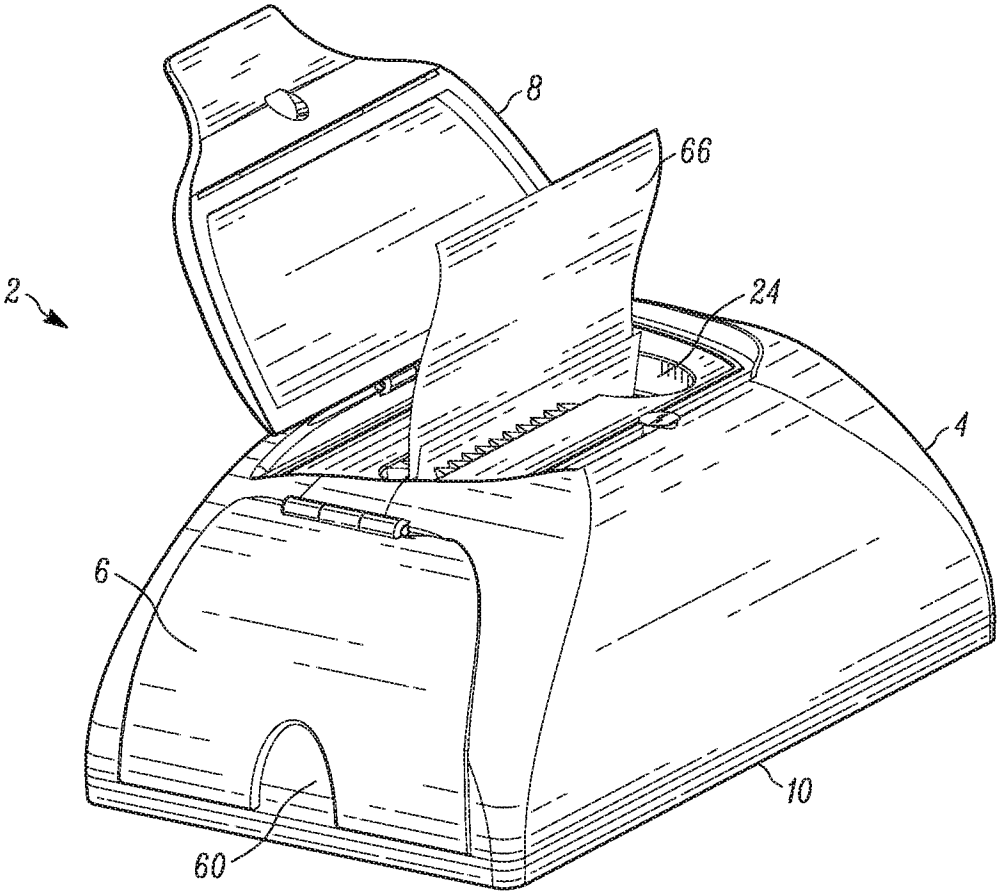
FIG. 24 is a perspective view of the dispenser of FIG. 1 showing the lid in an open position, and a wipe being withdrawn through the dispenser.

As shown in FIG. 24, upon installation of the cartridge within the dispenser 2, a user may access and withdraw wipes 66 through the aperture 24 of the dispenser 2.

In an alternative approach (not shown), the heights H1 and H2 of the grooves of the dispenser mounting interface are constant along the longitudinal axes of the grooves. In this approach, the heights of the rails of the cartridge interference fit regions may decrease along longitudinal axes of the rails. This will also permit the cartridge mounting interface to increasingly pull against the dispenser mounting interface during insertion of the cartridge, thereby creating an airtight seal between the two surfaces.

The dispenser mounting interface 48 and the cartridge mounting interface 70 are preferably formed of plastic materials, which each may be the same or different. For example, the dispenser mounting interface 48 may be polypropylene, and the cartridge mounting interface 70 may be polycarbonate. The use of different plastics having different rigidities is believed to assist in providing a sealing effect between the dispenser mounting interface 48 and the cartridge mounting interface 70. The components of the dispenser 2, including the dispenser body 4, loading door 6, and lid 8, may be made of any suitable material, such as polypropylene, polyethylene, or polycarbonate.

It is thus seen that an improved dispenser with substantial airtight features is provided. A first substantially airtight seal is provided between the lid 8 and the dispenser body 4 when the lid 8 is in the closed position. This inhibits ambient air from passing through the aperture 24 of the dispenser 2. A second substantially airtight seal is provided between the cartridge 60 and the dispenser 2. This inhibits ambient air that enters the interior cavity 42 of the dispenser from passing through the aperture 72 of the cartridge 60. This configuration is believed to prolong the usage life of the wipes 66 and inhibit bacteria from contacting the wipes 66.

Uses of singular terms such as "a," "an," are intended to cover both the singular and the plural, unless otherwise indicated herein or clearly contradicted by context. The terms "comprising," "having," "including," and "containing" are to be construed as open-ended terms. Any description of certain approaches or embodiments as "preferred" approaches or embodiments, and other recitation of approaches, embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. A dispenser comprising:

a dispenser body having an interior cavity, the dispenser body further comprising a dispensing surface having an aperture that communicates with the interior cavity;

a loading door attached to the dispenser body and permitting communication with the interior cavity;

a lid attached to the dispenser body, the lid being moveable between a closed position and a range of open positions, the lid permitting access to the aperture of the dispensing surface when in an open position and engaging the dispenser surface when in the closed position to thereby create a substantially gas impermeable seal; and a mounting surface disposed within the interior cavity and proximal the aperture of the dispensing surface, the mounting surface comprising a mounting interface, the mounting interface permitting substantially gas impermeable mounting of a cartridge while permitting access to the cartridge from the exterior of the dispensing body through the aperture of the dispensing surface.

2. The dispenser of claim 1, wherein the mounting interface comprises a first interference fit region.

3. The dispenser of claim 2, wherein the first interference fit region comprises a groove having a first groove height at a first groove region and a second groove height at a second groove region, the second groove height narrower than the first groove height.

4. The dispenser of claim 2, wherein the mounting interface comprises a second interference fit region.

5. The dispenser of claim 4, wherein the second interference fit region comprises a groove having a first groove height at a first groove region and a second groove height at a second groove region, the second groove height narrower than the first groove height.

6. The dispenser of claim 1, wherein at least one of the dispenser body and the lid comprises a magnet.

7. The dispenser of claim 6, wherein the dispenser body comprises a first magnet and the lid comprises a second magnet, the second magnet disposed opposite the first magnet when the lid is in the closed position.

8. The dispenser of claim 1, further comprising a separation surface.

9. The dispenser of claim 8, wherein the separation surface comprises a plurality of protrusions extending into the aperture.

10. The dispenser of claim 1, wherein the dispenser surface comprises a gasket.

11. The dispenser of claim 10, wherein lid engages the gasket when in the closed position to create a substantially gas impermeable seal between the lid and the gasket.

12. The dispenser of claim 1, wherein the dispenser body comprises a substantially flat exterior surface.

13. The dispenser of claim 12, wherein the substantially flat exterior surface further comprises a wall mount interface to permit mounting the dispenser to a wall.

14. A dispenser system comprising:

a cartridge, the cartridge comprising:

a cartridge body having an interior cartridge cavity;

a cartridge mounting interface disposed on an exterior of the cartridge body; and a plurality of sheet portions disposed within the interior cartridge cavity;

a dispenser, the dispenser comprising:

a dispenser body having an interior cavity, the dispenser body further comprising a dispensing surface having an aperture that communicates with the interior cavity;

a loading door attached to the dispenser body and permitting communication with the interior cavity;

a lid attached to the dispenser body, the lid being moveable between a closed position and a range of open positions, the lid permitting access to the aperture of the dispensing surface when in an open position and engaging the dispenser surface when in the closed position to thereby create a substantially gas impermeable seal; and a dispenser mounting surface disposed within the interior cavity and proximal the aperture of the dispensing surface, the dispenser mounting surface comprising a dispenser mounting interface, the dispenser mounting interface permitting substantially gas impermeable mounting of the cartridge while permitting access to the cartridge from the exterior of the dispensing body through the aperture of the dispensing surface.

15. The dispenser system of claim 14, wherein the cartridge mounting interface and the dispenser mounting interface engage to create a substantially gas impermeable seal.

16. The dispenser system of claim 14, wherein the dispenser mounting interface comprises a dispenser interference fit region configured to engage the cartridge mounting interface.

17. The dispenser system of claim 16, wherein the cartridge mounting interface comprises a cartridge interference fit region configured to engage the dispenser mounting interface.

18. The dispenser system of claim 17, wherein the cartridge interference fit region comprises a cartridge guide configured to engage a groove of the dispenser interference fit region.

19. A dispenser comprising:

a dispenser body having an interior cavity, the dispenser body further comprising a dispensing surface having an aperture that communicates with the interior cavity;

a loading door permitting communication with the interior cavity;

a lid, said lid being movable between a closed position and a range of open positions, the lid permitting access to the interior cavity when in an open position and creating a substantially gas impermeable seal when in the closed position and covering a dispensing aperture; and a mounting surface disposed within the interior cavity and proximal the aperture of the dispensing surface, the mounting surface comprising a mounting interface, the mounting interface permitting substantially gas impermeable mounting of a cartridge while permitting access to the cartridge from the exterior of the dispensing body through the dispensing aperture, the mounting surface comprising a first interference fit region, wherein the first interface region comprises a groove having a first groove height and a first groove region and a second groove height and a second groove region, the second groove height narrower than the first groove height.

20. A dispenser comprising:

a dispenser body having an interior cavity, the dispenser body further comprising a dispensing surface having an aperture that communicates with the interior cavity;

a loading door permitting communication with the interior cavity;

a lid, said lid being movable between a closed position and a range of open positions, the lid permitting access to the interior cavity when in an open position and creating a substantially gas impermeable seal when in the closed position and covering a dispensing aperture; and a mounting surface disposed within the interior cavity and proximal the aperture of the dispensing surface, the mounting surface comprising a mounting interface, the mounting interface permitting substantially gas impermeable mounting of a cartridge while permitting access to the cartridge from the exterior of the dispensing body through the dispensing aperture, the dispenser further comprising a separation surface, the separation surface comprising a plurality of protrusions extending into the aperture.

* * * * *